US005938895A

United States Patent [19]

Hirvonen

[11] Patent Number: 5,938,895

[45] Date of Patent: Aug. 17, 1999

[54] CALENDER HAVING MOISTURE PROFILE CONTROL

[75] Inventor: Kimmo Ilari Hirvonen, Charlotte, N.C.

[73] Assignee: Valmet Corporation, Helsinki, Finland

[21] Appl. No.: 09/054,230

[22] Filed: Apr. 2, 1998

[51] Int. Cl.[6] ..... D21G 1/00; B30B 15/30; B30B 3/04

[52] U.S. Cl. ..... 162/205; 162/206; 162/361; 100/73; 100/74; 100/161; 100/163 A

[58] Field of Search ..... 162/135, 136, 162/205, 206, 361; 100/35, 162 B, 161, 163 A, 73, 74, 75

[56] References Cited

U.S. PATENT DOCUMENTS

| | | | |
|---|---|---|---|
| 2,981,175 | 4/1961 | Goyette . | |
| 3,611,917 | 10/1971 | Bryce | 100/162 |
| 3,770,578 | 11/1973 | Spurrell . | |
| 4,114,528 | 9/1978 | Walker . | |
| 4,625,637 | 12/1986 | Pav et al. | 100/47 |
| 4,823,690 | 4/1989 | Stotz . | |
| 5,029,521 | 7/1991 | Pav et al. | 100/38 |
| 5,163,364 | 11/1992 | Bubik et al. | 100/38 |
| 5,269,885 | 12/1993 | Tavi | 162/358.1 |
| 5,522,312 | 6/1996 | Johnson . | |
| 5,590,593 | 1/1997 | Korhonen et al. | 100/93 |
| 5,607,553 | 3/1997 | Chadha . | |
| 5,649,478 | 7/1997 | Chadha . | |
| 5,662,037 | 9/1997 | Van Haag | 100/331 |

*Primary Examiner*—Peter Chin
*Assistant Examiner*—Kevin Cronin
*Attorney, Agent, or Firm*—Alston & Bird LLP

[57] ABSTRACT

A calender is provided for calendering a fibrous web wherein the moisture profile of the web can be controlled. The calender includes a plurality of rolls wherein at least one of the rolls comprises a profiling roll. The profiling roll has a plurality of profiling zones extending in a cross-machine direction to define a profiling nip. The roll is independently expandable in each of the zones, such as by an internal pressurized shoe arrangement, so that the pressure in the profiling nip can be varied in the cross-machine direction. A waterbox is positioned adjacent to the profiling nip and water is carried directly into the profiling nip where at least a portion of the water is transferred to the web such that the moisture profile of the web can be varied in the cross-machine direction by varying the nip pressure in the respective profiling zones.

30 Claims, 4 Drawing Sheets

CALENDER HAVING MOISTURE PROFILE CONTROL

FIELD OF THE INVENTION

The present invention relates to papermaking machines, and more particularly relates to calenders for calendering fibrous webs produced in papermaking machines.

BACKGROUND OF THE INVENTION

After a fibrous web, such as paper, is formed on a papermaking machine, the web is typically advanced through a calender which improves various parameters of the web. For example, surface smoothness and caliper are parameters of the web and resultant sheet which can be controlled by advancing the web through a calender.

One particularly advantageous type of calender is known as a wet stack calender. In a wet stack calender, several rolls are arranged in nipping contact and with their axes generally vertically aligned one above the other. The web is wound down through the stack of rolls in a serpentine fashion alternating from one side of one roll, through a nip, and around the other side of the subjacent roll until the web exits from the bottom of the stack. The lowermost roll is sometimes referred to as the king roll. One or more waterboxes are arranged adjacent to the side of a roll which is exposed and not in contact with the web. The waterboxes are usually positioned at intermediate positions in the stack (e.g., adjacent to the second or third rolls up from the king roll in a five-roll stack).

As the roll rotates into the nip, the inrunning surface portion of the roll is supplied with water from the waterbox which carries the water into the nip such that the water is transferred to the web. One example of such a wet stack calender is illustrated in U.S. Pat. No. 5,607,553 which illustrates the use of a brush spray device for supplying water to the exposed inrunning surface portion of a roll. Similarly, a waterbox having a metering element such as a blade for applying a film to the surface of a roll is disclosed in U.S. Pat. No. 5,522,312.

One recurring problem faced by paper manufacturers is ensuring uniformity of web properties in the cross-machine direction. In other words, in order to provide a more uniform and therefore superior product, it is desirable to reduce variation in the parameters across the width of the web. These variations can be caused by many factors including, for example, the effects of gravity on the various components of the papermaking machine.

One approach to adjusting the profile of the web has been to vary the diameter of the king roll in the cross-machine direction. For example, the king roll can be provided with a machined crown to account for the effects of gravity on the roll. The crown may also be controlled during machine operation by providing a roll having an outer shell and an interior hydraulic chamber provided in sealing contact with the inner surface of the outer shell. Accordingly, to control the crown of the king roll, the hydraulic pressure inside the chamber is adjusted which varies the deflection of the outer shell. The king roll may also be provided with one or more hydraulically mounted shoes which press against the inner surface of the outer shell to radially expand the roll. The actuation of the shoes is sometimes independently controlled so that the pressure in the nip can be adjusted to a desired profile.

U.S. Pat. No. 4,114,528 discloses a device for controlling the caliper of a web issuing from a nip of a plural roll device, such as a calender. One of the rolls of the device is subjected to a multiplicity of air jets which impinge air of various temperatures on the roll. By increasing the temperature of the air in any one or group of the jets, the material of the roll is slightly expanded which increases the diameter of the roll adjacent to that air jet and increases the pressure in the nip, thereby reducing the caliper of the web.

Prior attempts at profile control have been limited to smoothness and caliper control in the nip with the king roll. In other words, it has been considered the best approach to vary the pressure in the nip formed with the king roll (the last nip to which the web is subjected in the stack) to vary the caliper and smoothness profile of the web.

While proper caliper and smoothness are important to a finished web, it has been determined that the moisture profile of the web before final drying is also important to proper web formation. The water applied to the web in the calender helps add surface smoothness without a substantial decrease in bulk. However, if the moisture profile in the cross-machine direction is not sufficiently uniform, various other properties of the web can be deleteriously affected. In addition, the runnability of the machine can be impaired. With the conventional approach of varying the nip pressure of the final nip with the king roll, the properties which are most affected are caliper and smoothness profile. Although the moisture profile can be varied somewhat by adjusting this nip pressure, the resultant changes in caliper and smoothness prevent significant control of the moisture profile and the advantages attendant to a proper profile.

Accordingly, there has become a great desire in the papermaking industry to provide control of the moisture profile of the web in a wet calender stack. Separating the control of the moisture profile from the control of the web caliper and smoothness has not previously been feasible. There is a significant need for a calender wherein the moisture profile of the web can be isolated and separately controlled.

SUMMARY OF THE INVENTION

These and other goals and advantages are met by the calender apparatus and associated method according to the present invention which includes a profiling roll having a plurality of profiling zones extending in a cross-machine direction. The profiling roll has an outer shell which is expanded independently for each of the profiling zones. A waterbox is positioned adjacent to the nip of the profiling roll for supplying water to the profiling nip. Accordingly, water is carried from the waterbox directly into the profiling nip where at least a portion of the water is transferred to the web. The amount of water transferred can be varied in the cross-machine direction by varying the nip pressure in the respective profiling zones. By providing a nip having several profiling zones immediately adjacent to the waterbox, the present invention advantageously allows the moisture profile to be directly controlled in the wet stack calender without effecting any significant variation in caliper or smoothness. As such, the present invention provides great advantages in web parameter control which could not be achieved with conventional prior art calender devices.

In particular, a preferred embodiment of the invention comprises a calender having a plurality of rolls for applying pressure to the web. The rolls are arranged adjacent to each other to form at least one nip between the adjacent rolls. The web is advanced towards the nip in a manner that an inrunning surface portion of at least one of the rolls forming the nip is exposed and not in contact with the web. The profiling roll which, as discussed above, has a plurality of profiling zones extending in a cross-machine direction, comprises at least one of the rolls of the nip. The profiling roll has an outer shell which is radially expandable in a direction towards the other roll of the profiling nip. The outer shell is independently expandable for each of the profiling zones such that the pressure in the profiling nip can be varied in the cross-machine direction.

One way in which the roll can be expanded is by providing a beam within the outer shell and a plurality of shoes mounted on a plurality of hydraulic cylinders supported on the beam. The shoes apply pressure to the inner surface of the outer shell to radially expand the outer shell and increase the pressure in the profiling nip of the respective profiling zone.

The waterbox is positioned adjacent to the profiling nip and supplies water to the inrunning surface portion of the exposed roll (which may be either the profiling roll or the roll which is in nip contact with the profiling roll). The inrunning surface portion of the exposed roll thus carries water as it rotates from the waterbox directly into the profiling nip. At least a portion of the water is transferred to the web in an amount which can be varied in the cross-machine direction by varying the nip pressure in the respective profiling zones.

The profiling roll may also further include a second plurality of shoes mounted to respective hydraulic cylinders at a location on the beam opposite the first plurality of shoes. Consequently, the outer shell can be radially expanded in two different directions (such as vertically up and down) to thereby form first and second profiling nips with the adjacent rolls. A second waterbox is positioned adjacent to the second profiling nip for supplying water to the exposed inrunning surface portion of one of the rolls. Advantageously, the web is wound around a portion of the profiling roll between the two profiling nips. The first waterbox applies water to the exposed inrunning surface portion of the profiling roll immediately upstream of the first profiling nip, and the second waterbox applies water to the exposed inrunning surface portion of the roll forming the second profiling nip with the profiling roll. In this fashion, the moisture profile of the web can be even more finely adjusted to desired target values, which further increases the overall quality of the finished product.

BRIEF DESCRIPTION OF THE DRAWINGS

Some of the objects and advantages of the invention have been set forth and other objects and advantages of the invention will become apparent in the detailed description of the preferred embodiments of the invention to follow, when taken in conjunction with the accompanying drawings, which are not necessarily drawn to scale.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
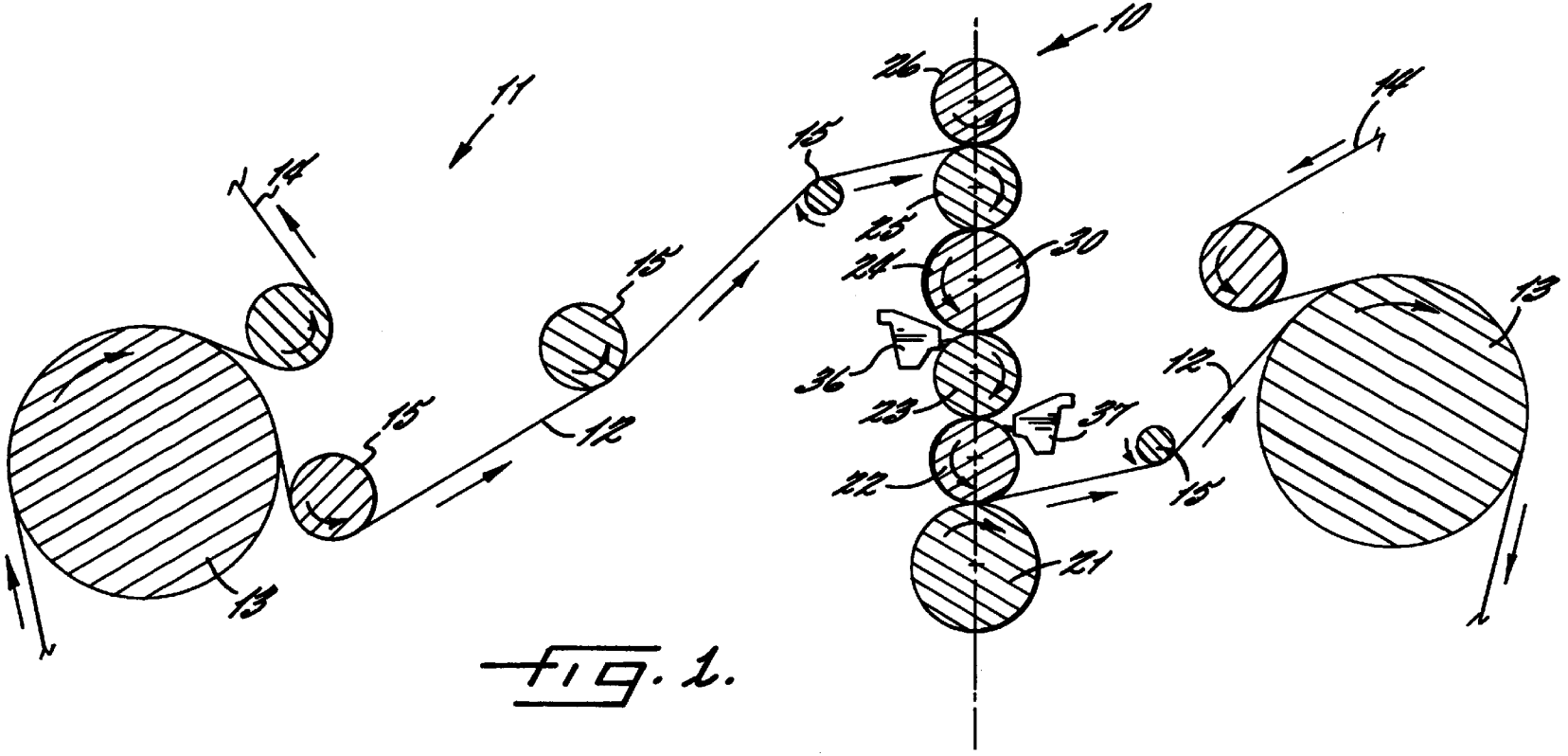
FIG. 1 is a schematic side view of the calender according to the present invention which illustrates the path of the web through the papermaking machine.

FIG. 1 illustrates the calender stack apparatus 10 according to the present invention and part of a papermaking machine 11. The details of the papermaking machine 11 are not critical to the operation of the present invention and thus the papermaking machine may be of a conventional type for forming a fibrous web 12. The web may be of any variety formed in industry including the various grades of paper, paperboard and cardstock. After the web 12 has been newly formed, it is advanced through a first dryer before reaching the calender stack 10. The web is wound around a dryer cylinder 13, and a dryer felt 14 is wound partially around the dryer cylinder and over the web 12. Upon leaving the dryer, the web is then wound around one or more guide rollers 15 before being fed into the calender stack 10. A measuring unit of conventional configuration can be situated adjacent to the web 12 and between the dryer and the calender stack 10 for measuring various properties and parameters of the web.

The web 12 is wound through the various rolls of the calender stack 10 in the serpentine fashion illustrated in FIG. 1 and as discussed more fully below. Upon exiting the calender stack 10, the web is then advanced around one or more further guide rollers 15 to a second dryer which, similar to the first dryer, includes a dryer cylinder 13 and a dryer felt 14. The web 12 is then advanced to further finishing equipment or to a reel-up where the web is wound onto reel-spools.

Figure 2:
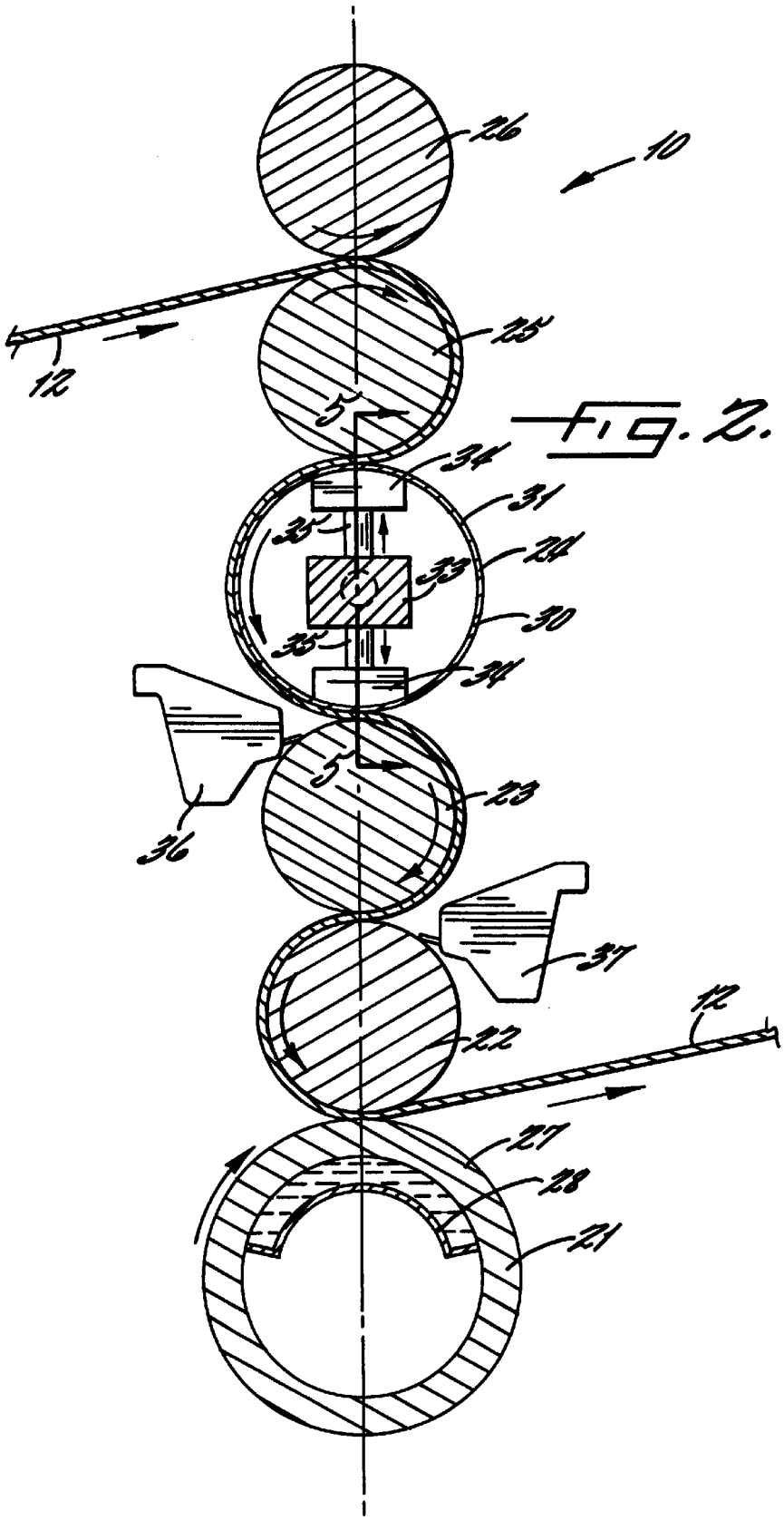
FIG. 2 is an enlarged sectional view of the calender stack illustrating the positions of the various rolls according to one embodiment of the invention wherein the profiling roll is in the fourth roll position from the bottom of the stack.

FIG. 2 illustrates in more detail the calender stack 10 of the present invention. A plurality of rolls is provided in a generally vertically arranged stack wherein each of the rolls forms a nip with an adjacent roll. The lowest roll 21 or king roll may be of a larger diameter than the other rolls. Immediately above the king roll 21 are second 22, third 23, fourth 24, fifth 25 and sixth 26 rolls which may be of similar diameter. The web 12 is first introduced into the nip between the fifth 25 and sixth 26 rolls and then is wound in the illustrated serpentine fashion through the nips between the respective lower rolls. The web 12 exits the calender 10 through the nip between the king roll 21 and the second roll 22.

Each of the rolls 21–26 is supported in a bearing house mounted on a frame. Each of the rolls 21–26 may be movable relative to the frame in the vertical direction such that the nip loads between the adjacent rolls can be varied as desired by changing the vertical position of the rolls. However, at least one roll is fixed, which is preferably the king roll 21 or the second roll 22.

The king roll 21 is provided with an outer shell 27 and a hydraulic chamber 28 extending the length of the roll. As is known in the industry, the hydraulic chamber 28 is in sealing contact with the inner surface of the outer shell 27 such that, if the pressure in the hydraulic chamber is increased, the medial portion of the roll (in the cross-machine direction) will be bowed outwardly. Thus, the crown of the king roll 21 can be adjusted to compensate for nip load deflection. The king roll 21 may also be of the type having a predetermined crown profile machined into the face of the roll before assembly of the stack. The king roll 21 is preferably connected to a drive apparatus for driving the roll, although other rolls can also or alternatively be driven (it is usually best to drive whichever roll is fixed).

Figure 3:
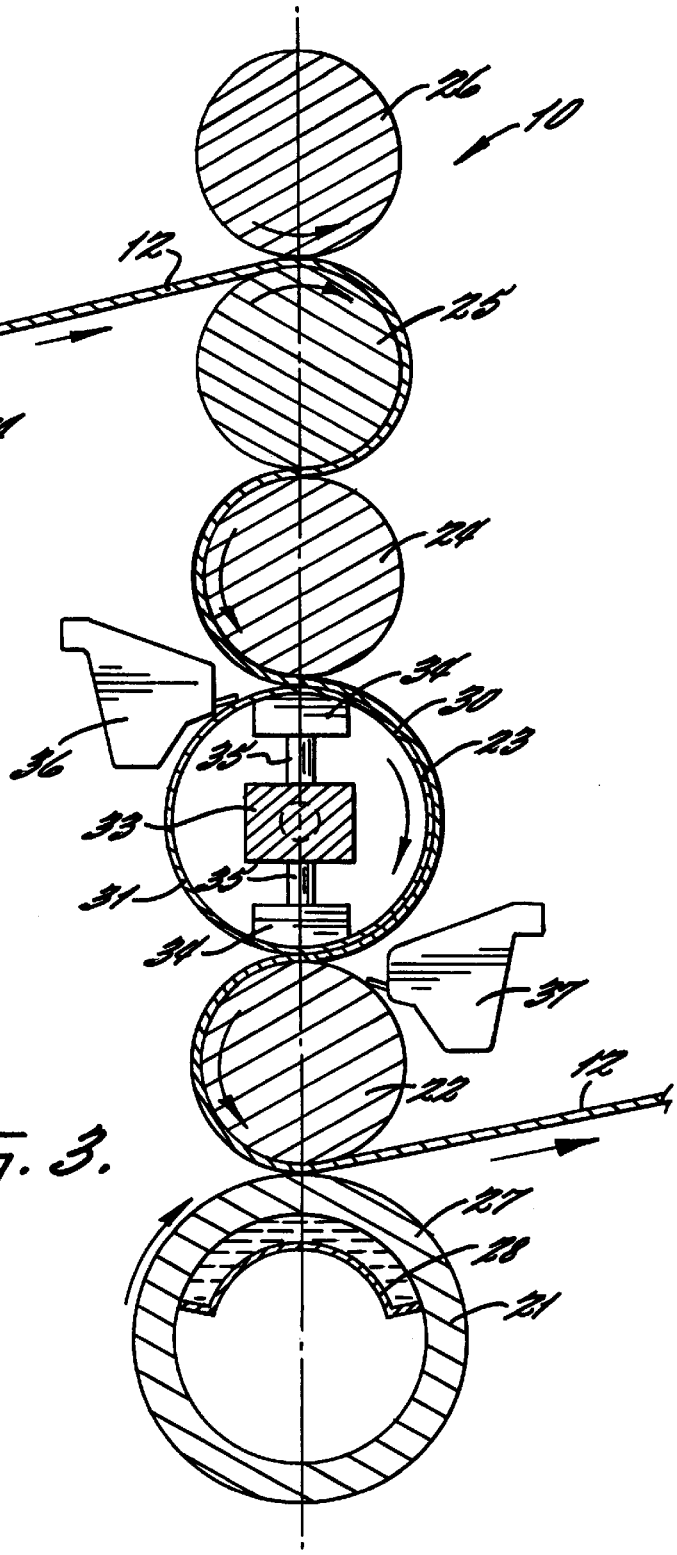
FIG. 3 is an enlarged sectional view of another embodiment of the invention wherein the profiling roll is in the third roll position from the bottom of the stack.

One advantageous feature of the present invention is the use of a profiling roll at an intermediate position in the stack. As shown in FIG. 3, the profiling roll comprises the third roll 23 whereas in FIGS. 2 and 4, the profiling roll comprises the fourth roll 24. Regardless of the actual position and the total number of rolls, the profiling roll will be referred to consistently herein by element number 30.

Figure 5:
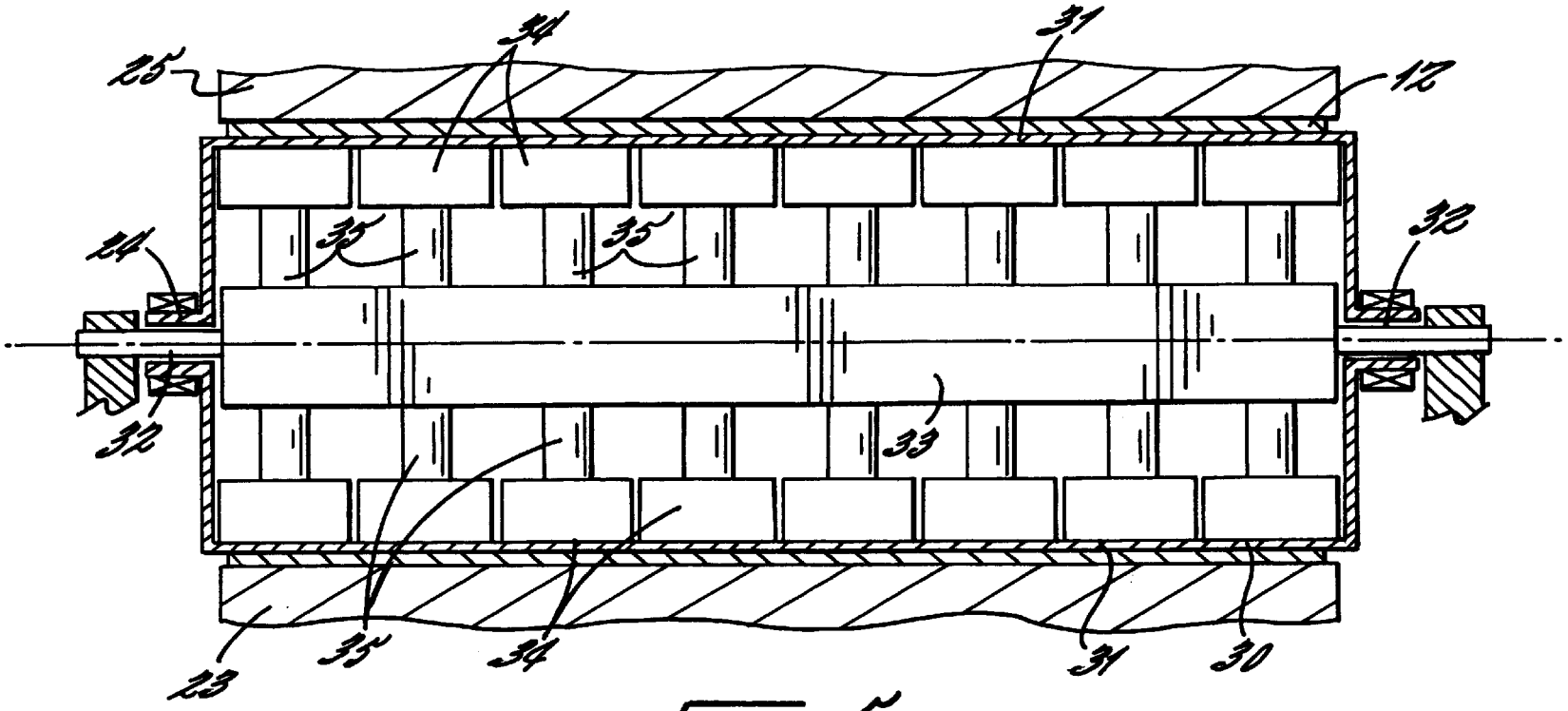
FIG. 5 is an axial cross-section of a profiling roll taken along lines 5—5 of FIG. 2 illustrating two rows of eight shoes which define respective profiling zones for adjusting the nip pressure in the cross-machine direction.

The profiling roll 30 may be slightly larger in diameter than the adjacent rolls. In particular, a profiling roll diameter of 680 millimeters has been found to be advantageous. The profiling roll 30 includes an outer shell 31 which is slightly flexible in nature. Although preferably formed of steel or cast iron, the outer shell 31 is of a size and shape which allows some radial expansion relative to the roll axis. The outer shell 31 is supported at its ends, as can be seen in FIG. 5, on a pair of rotatably supported shafts 32. As with the other rolls, the shafts 32 can be supported for slight movement up and down to allow changes in the desired nip loading. The profiling roll 30 may also be driven.

A fixed beam 33 is provided within the outer shell 31 and is supported at its ends such that the beam does not rotate within the shell. The beam 33 supports a plurality of shoes 34 against the inner surface of the outer shell 31. Each of the shoes 34 has an arcuate surface in sliding contact with the inner surface of the outer shell 31. The interfaces of the arcuate shoes 34 and the outer shell 31 are lubricated to reduce friction and heat buildup. Each of the shoes 34 is supported on the beam 33 by way of an actuator 35 such as a hydraulic cylinder. However, it will be appreciated that other actuators could be used including pneumatic cylinders and the like.

Each of the actuators 35 is independently controllable. Accordingly, a plurality of profiling zones is advantageously created which allows adjustment of the nip profile in the cross-machine direction. For example, in the embodiment illustrated in FIG. 5, eight profiling zones are provided along the upper surface of the profiling roll 30 to form a first profiling nip with the roll 25 immediately above the profiling roll. Although each zone is illustrated with only one shoe 34, it is to be appreciated that each zone may include several shoes on a common actuator or several shoes on separate actuators which have a common controller.

Figure 4:
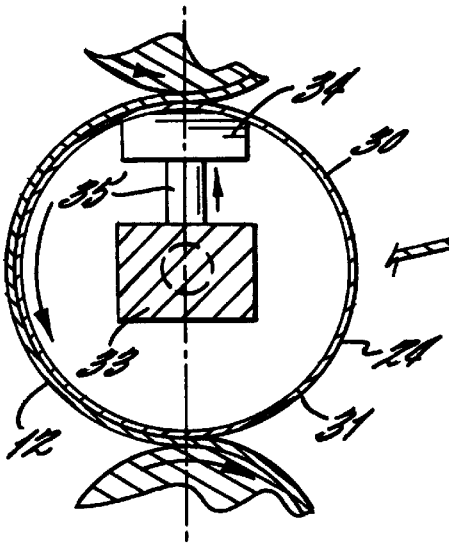
FIG. 4 is a greatly enlarged sectional view of a profiling roll having a plurality of shoes on only one side of a central beam.

A second plurality of eight profiling zones is provided by the downward facing shoes 34 to thereby form a second profiling nip with the immediately lower roll 23. Accordingly, the profiling roll 30 creates two profiling nips in sequence, both of which can be adjusted to vary the nip profile between the rolls. However, the invention is not limited to the use of two opposed rows of shoes and, as illustrated in FIG. 4, shoes 34 may be mounted on only one side of the beam 33. As a further alternative, the profiling zones could be formed by providing a heating apparatus capable of differentially heating the profiling roll 30 along its length such that an increase in the diameter of the roll is caused by thermal expansion.

An advantage of the configuration illustrated in FIG. 3 is that first and second waterboxes 36,37 can be positioned in spaced adjacency with the first and second profiling nips. As shown in FIG. 2, however, the second waterbox 37 could also provide water to a nip where neither of the rolls is a profiling roll.

The waterboxes 36,37 can be of any conventional configuration including brush and/or spray type devices. In the waterboxes 36,37 illustrated, a trough is provided which has a lip in contact with one of the rolls leading into the nip. The trough is filled with water to the extent that water flows over the lip and onto the surface of the respective roll. It will be appreciated by one of ordinary skill in the art that one of the inrunning surface portions of the adjacent rolls forming the nip will be exposed and not in contact with the web 12. The lip of the waterbox is placed in contact with this exposed inrunning surface portion such that the water is carried into the nip as the respective roll rotates. In the present invention, the water can be supplied to the exposed inrunning surface portion of the profiling roll 30, as in the case of the first waterbox 36 in FIG. 3, or can be applied to the exposed inrunning surface portion of an adjoining roll, as in the case of the second waterbox 37 in FIG. 3 and the first waterbox 36 in FIG. 2.

The water from the waterboxes 36,37 is thus advanced into the respective profiling nip on the exposed surface of the roll. Advantageously, because the nip profile can be independently controlled, the amount of water absorbed by the web running into the nip can also be controlled. For example, if a higher nip pressure is maintained in the medial portion of the roll, less water will be absorbed in the corresponding portion of the web. The excess water will remain on the inrunning surface portion of the respective roll and will not be absorbed by the web. Likewise, if it is desired to absorb more water at one or more positions along the width of the web, the respective shoes can be adjusted to lessen the nip pressure and allow more water absorption.

Thus, the present invention provides a unique and highly beneficial way of adjusting the amount of water absorbed by the web and the resultant moisture profile. By allowing adjustments of the moisture profile, the overall properties of the web can be improved and any deficiencies in preceding portions of the papermaking machinery can be compensated. Similarly, a non-uniform moisture profile can be effected in advance of subsequent finishing operations, such as caliper and smoothness adjustments performed by the king roll, so that the finished web has a more uniform nature. Also, the runnability of the machine is improved, wrinkles in the web are reduced and web breaks due to overwatering of the web can be eliminated.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A calender for calendering a fibrous web produced in a papermaking machine, said calender comprising:

a plurality of rolls for applying pressure to the web which are arranged to form at least one nip between adjacent rolls, the web being advanced towards the nip in a manner that an inrunning surface portion of at least one of the rolls forming the nip is exposed and not in contact with the web;

a profiling roll comprising at least one of the rolls of the nip and having a plurality of profiling zones extending in a cross-machine direction such that the nip comprises a profiling nip, said profiling roll having an outer shell which is radially expandable in a direction towards the other roll of the profiling nip and further which is independently expandable for each of the profiling zones such that the pressure in the profiling nip can be varied in the cross-machine direction; and a waterbox positioned adjacent to said profiling nip for supplying water to the inrunning surface portion of the exposed roll, said inrunning surface portion carrying water from the waterbox and into the profiling nip where at least a portion of the water is transferred to the web such that the moisture profile of the web can be varied in the cross-machine direction by varying the nip pressure in the respective profiling zones.

2. A calender as defined in claim 1 wherein said profiling roll further comprises:

a beam mounted within said outer shell;

a plurality of actuators mounted on the beam; and a plurality of shoes mounted on the actuators for movement against the outer shell, said shoes applying pressure to the inner surface of the outer shell to radially expand the outer shell and increase the pressure in the profiling nip of the respective profiling zone.

3. A calender as defined in claim 2 wherein said actuators comprise hydraulic cylinders.

4. A calender as defined in claim 2 further comprising a second plurality of actuators mounted to said beam and a second plurality of shoes mounted to the respective actuators to define a second plurality of profiling zones such that the outer shell can be radially expanded against another roll and a second profiling nip is formed therewith.

5. A calender as defined in claim 4 wherein the web is advanced towards the second profiling nip in a manner that an inrunning surface portion of at least one of the profiling roll and the other roll of the second profiling nip is exposed and not in contact with the web, and further comprising a second waterbox positioned adjacent to the second profiling nip for supplying water to the inrunning surface portion of the exposed roll.

6. A calender as defined in claim 5 wherein the inrunning surface portion of the roll forming the second profiling nip with the profiling roll is exposed and the second waterbox supplies water to said roll so that water is carried into the second profiling nip.

7. A calender as defined in claim 1 wherein the inrunning surface portion of the profiling roll is exposed and the waterbox supplies water to the profiling roll so that water is carried into the first profiling nip.

8. A calender as defined in claim 1 wherein one of the pair of rolls forming the last nip is crowned.

9. A calender as defined in claim 8 wherein said one roll of the last nip comprises an outer shell and at least one hydraulic chamber inside the outer shell for varying the pressure in the last nip.

10. A calender as defined in claim 1 wherein said profiling roll comprises eight profiling zones.

11. A calender as defined in claim 1 comprising six rolls and wherein the profiling roll is the third roll from the bottom.

12. A calender as defined in claim 1 comprising six rolls and wherein the profiling roll is the fourth roll from the bottom.

13. A calender for calendering a fibrous web produced in a papermaking machine, said calender comprising:

a plurality of rolls for applying pressure to the web, one of said rolls being arranged adjacent to each of two other rolls to form two nips;

a profiling roll comprising said one roll and having a plurality of profiling zones extending in a cross-machine direction such that the two nips comprise first and second profiling nips respectively with each of the other two rolls, said profiling roll having an outer shell which is radially expandable in a direction towards the other roll of the respective profiling nip and further which is independently expandable for each of the profiling zones such that the pressure in the profiling nip can be varied in the cross-machine direction; and a waterbox positioned adjacent to at least one of said profiling nips for supplying water into the profiling nip where at least a portion of the water is transferred to the web such that the moisture profile of the web can be varied in the cross-machine direction by varying the nip pressure in the respective profiling zones.

14. A calender as defined in claim 13 wherein said profiling roll further comprises:

a beam mounted within said outer shell;

a first plurality of actuators mounted on the beam;

a second plurality of actuators mounted on the beam at a position spaced from the first plurality of actuators; and first and second pluralities of shoes mounted on the respective actuators for movement against the outer shell, said shoes applying pressure to the inner surface of the outer shell to radially expand the outer shell and increase the pressure in the profiling nip of the respective profiling zone.

15. A calender as defined in claim 14 wherein said actuators comprise hydraulic cylinders.

16. A calender as defined in claim 13 wherein the web is advanced sequentially around the roll forming the first profiling nip with the profiling roll, the profiling roll itself and the roll forming the second profiling nip with the profiling roll, such that the inrunning surface portion of the profiling roll leading into the first profiling nip is exposed and not in contact with the web and the inrunning surface portion of the roll forming the second profiling nip with the profiling roll is exposed and not in contact with the web.

17. A calender as defined in claim 16 wherein the waterbox is positioned to supply water to the inrunning surface portion of the profiling roll for carrying the water into the first profiling nip.

18. A calender as defined in claim 16 wherein the waterbox is positioned to supply water to the inrunning surface portion of the roll forming the second profiling nip with the profiling roll for carrying water into the second profiling nip.

19. A calender as defined in claim 13 wherein one of the pair of rolls forming the last nip is crowned.

20. A calender as defined in claim 19 wherein said one roll of the last nip comprises an outer shell and at least one hydraulic chamber inside the outer shell for varying the pressure in the last nip.

21. A calender as defined in claim 13 wherein said profiling roll comprises eight profiling zones for each of the profiling nips.

22. A calender as defined in claim 13 comprising six rolls and wherein the profiling roll is the third roll from the bottom.

23. A calender as defined in claim 13 comprising six rolls and wherein the profiling roll is the fourth roll from the bottom.

24. A method of calendering a fibrous web produced in a papermaking machine, said method comprising the steps of:

advancing the web around a plurality of rolls arranged to form at least one nip between adjacent rolls;

further advancing the web towards the nip in a manner that an inrunning surface portion of at least one of the rolls forming the nip is exposed and not in contact with the web;

radially expanding one of the rolls to increase the pressure applied to the web in the nip, said expanding step being performed independently in each of a plurality of profiling zones extending in the cross-machine direction such that the nip pressure can be varied in each of the zones;

supplying water to the inrunning surface portion of the exposed roll; and rotating the exposed roll such that the inrunning surface portion carries water into the nip where at least a portion of the water is transferred to the web such that the moisture profile of the web can be varied in the cross-machine direction by varying the nip pressure in the respective profiling zones.

25. A method as defined in claim 24 wherein said step of expanding a roll further comprises pressing a plurality of shoes radially outwardly against an inner surface of an outer shell of the roll to radially expand the outer shell and increase the pressure in the nip in the respective profiling zone.

26. A method as defined in claim 25 wherein said shoe pressing step is accomplished by actuating a plurality of hydraulic cylinders.

27. A method as defined in claim 25 wherein said step of expanding a roll further comprises pressing a second plurality of shoes to define a second plurality of profiling zones such that the outer shell can be radially expanded against another roll and a second nip is formed therewith.

28. A method as defined in claim 27 further comprising:

advancing the web towards the second nip in a manner that an inrunning surface portion of at least one of the rolls forming the second nip is exposed and not in contact with the web;

supplying water to the inrunning surface portion of the exposed roll forming part of the second nip; and rotating the exposed roll such that the inrunning surface portion carries water into the nip where at least a portion of the water is transferred to the web such that the moisture profile can be varied in the cross-machine direction by varying the nip pressure in the second plurality of profiling zones.

29. A method as defined in claim 28 wherein said step of supplying water to the inrunning surface portion of the exposed roll forming part of the second nip comprises supplying water to the roll forming the second nip with the roll which is radially expanded.

30. A method as defined in claim 24 wherein said step of supplying water to the inrunning surface portion of the exposed roll forming part of the first nip comprises supplying water to the roll which is radially expanded.

* * * * *